United States Patent [19]

Jacobs

[11] Patent Number: 4,567,655

[45] Date of Patent: Feb. 4, 1986

[54] TOOL FOR OPENING SMOKELESS TOBACCO CONTAINERS

[75] Inventor: David C. Jacobs, Veneta, Oreg.

[73] Assignee: Gordon G. Hart, Junction City, Oreg. ; a part interest

[21] Appl. No.: 663,163

[22] Filed: Oct. 22, 1984

Related U.S. Application Data

[63] Continuation of Ser. No. 456,838, Jan. 10, 1983, abandoned.

[51] Int. Cl.[4] ..... B67B 7/00

[52] U.S. Cl. ..... 30/2; 30/1.5; 30/426

[58] Field of Search ..... 30/1.5, 2, 292, 307, 30/418, 426, 400, 289, 290, 294

[56] References Cited

U.S. PATENT DOCUMENTS 628,775 7/1899 Disston ..... 30/317
1,614,578 1/1927 Thom ..... 30/2
2,573,381 10/1951 Arnold ..... 30/2

*Primary Examiner*—Douglas D. Watts
*Attorney, Agent, or Firm*—Klarquist, Sparkman, Campbell, Leigh & Whinston

[57] ABSTRACT

A lightweight, hand-held portable tool for opening a smokeless tobacco container uses a rotatable cutting wheel to slit an adhesive coated paper wrapper extending around the rim of the lid and cylindrical body of the container. The tool has a top member which rests on the circular lid to fix the position of the cutting wheel at a distance therebelow. The cutting wheel is recessed in a body member perpendicularly disposed to the top member to restrict the cutting depth to the combined thickness of the rim and wrapper. The tool includes grasping surfaces for the user and a guide member shaped to conform to the side surface of the container so that the opening operation can be accomplished by revolving the tool about the body of the container as the top member rests on the lid.

3 Claims, 4 Drawing Figures

TOOL FOR OPENING SMOKELESS TOBACCO CONTAINERS

This is a continuation of application Ser. No. 456,838, filed Jan. 10, 1983 now abandoned.

BACKGROUND OF THE INVENTION

1. Field of the Invention

This invention relates to means for opening smokeless tobacco containers, and more particularly, to a hand-held portable tool having a rotatable circular cutting means to slit the adhesive coated paper wrapper securing the lid to the outer side surface of the container.

2. Description of Related Prior Art

A smokeless tobacco container generally has paper side and bottom surfaces and includes a metallic lid having a dependent flange or rim that fits over the outer side surface of the container. An adhesive coated paper wrapper extends around the outer periphery of the side surface of the container and the rim of the lid to seal the container. Containers and lids made of plastic are also available but are configured, assembled, and sealed by paper wrappers as described above. Typically, a user of smokeless tobacco opens the container by inserting his thumbnail or the edge of a pocketknife through the paper wrapper seal at a point just below the rim of the lid. Using his other hand, he then rotates the container while fixing his thumbnail or pocketknife edge underneath the rim of the lid.

The use of the thumbnail as a cutting device not only requires long thumbnails, which are then susceptible to breakage, but also is a laborious means for opening the container. The use of a pocketknife is equally undesirable because of both the potential injury to the user from slippage of the knife from underneath the rim and the destruction of the smokeless tobacco container caused by the exertion of excessive radial pressure which induces a slit in the side of the container together with the paper wrapper.

The prior art has not provided an acceptable tool for this purpose. A hand tool designed to open watch cases is disclosed by Southworth U.S. Pat. No. 451,982. This tool embodies a circular plate having thin, beveled edges around the periphery thereof with a support means on either surface to ensure a firm grasping of the tool by its user. The tool is designed to pry open containers by inserting the edge of the tool in the groove between the lid and the body of the container. Successful operation of the tool requires that the container have firm sides to support the forces created while the user pries open the lid. Smokeless tobacco containers, however, are cylindrically shaped having paper or thin plastic side and bottom surfaces covered by a lid. The Southworth tool is unsuitable for opening containers of this type because it requires a container with sides sufficiently rigid to support a prying operation.

In addition, the Southworth tool requires a groove or predetermined course into which the tool is inserted and can follow. Opening a smokeless tobacco container, however, requires the use of a sharp edged tool to form a path around the periphery of the container.

A wall-mounted device used in an advertisement display by United States Tobacco Company provides a means for opening smokeless tobacco containers. This device includes an open ended cylinder which is anchored on a wall with the axis of the cylinder disposed perpendicular thereto. The smokeless tobacco container is inserted into the cylinder with the lid facing the wall. Around the periphery of the inner surface of the cylinder is an inwardly radially extending fluted cutting edge positioned to engage the side of the container below the rim of the lid. The user inserts the smokeless tobacco container into the device and exerts a force in the direction of the cutting edge while rotating the container about the inner periphery of the tool. This device suffers from the disadvantage of being nonportable in that it is both designed to be wall-mounted and necessarily has a diameter larger than the smokeless tobacco container itself. Furthermore, the tool has a relatively large exposed cutting edge, which if transported for on-site use, is susceptible to either the snagging of clothing or injuring the person attempting to use the device. In addition, the operation of opening the container requires an awkward distribution of forces for simultaneously rotating the container, urging the container laterally against the wall-mounted top of the device, and changing the direction of a radial force against the cutting edge along the periphery of the tool.

Neither of the means discussed hereinabove discloses a hand-held portable tool capable of directing a constant radial force at a predetermined depth from the top of the lid to accomplish opening the container while leaving the side surface intact. A primary object of this invention is, therefore, to accomplish this task by providing a lightweight, hand-held portable tool to open a smokeless tobacco container. The tool has means both to fix the position of a rotatable cutting edge below the rim of the lid and restrict the depth of the slit for an effective and predictable opening operation. The tool is of lightweight construction and sufficiently small to be carried on a key chain.

An important primary object of this invention is to provide a tool having grasping surfaces and a guide means to allow a sure-handed opening operation with a constant radial force applied to the container.

A further important object of this invention is to provide a tool whereby the smokeless tobacco container may be opened by rotating the container, the tool, or a combination of both.

Still another important object of this invention is to provide a portable tool having a cutting edge with a protective means to avert injury to the person transporting or using the tool.

SUMMARY OF THE INVENTION

The present invention overcomes the deficiencies inherent in the prior art discussed hereinabove by providing a hand-held portable tool having the capability of self-aligning the direction of the forces necessary to open properly a smokeless tobacco container. The tool comprises a holder means that both supports grasping surfaces and contains a rotatable cutting means, preferably a wheel made of high alloy stainless or chrome molybdenum steel, for slitting the paper wrapper to open the container. The cutting wheel is rotatably mounted with its axis of rotation parallel to the axis of the cylindrical container being opened and recessed in the holder means so that only the cutting edge is exposed. A positioning means on the holder means engages the container to position the cutting wheel below the dependent flange of the container lid and restricts the cutting depth to the thickness of the dependent flange. The positioning means includes a means to guide the cutting wheel relative to the periphery of the container. During a cutting operation, the tool is urged against the side surface of the container with the cutting wheel offset laterally thereof to restrict the cutting depth to slit only the adhesive coated paper wrapper adhering to the lid and side of the container.

A first top-mounted flange which rests on the lid of the container to position the cutting wheel at a uniform depth just below the rim of the lid and a first concave surface to guide the tool along the side surface of the container constitute the positioning means. A second top-mounted flange and a second concave surface on the side of the holder opposite to that which engages the container constitute grasping surfaces for the user. To open a container, the user grasps the second flange between his thumb and index finger with the nail-bearing side of the index finger resting against the second concave surface. The tool is then revolved about the container so that the cutting wheel can slit the paper wrapper. The first concave surface conforms to and guides the tool along the cylindrical surface of the container as it revolves about the container. The container may also be opened by revolving the container while the tool remains stationary.

The first top-mounted flange and the first concave surface from which the cutting wheel protrudes ensure an accurate, efficient cutting operation by self-aligning the necessary forces as the tool rests against the lid and side of the container.

The foregoing and other objects, features and advantages of the present invention will become more apparent from the following detailed description which proceeds with reference to the accompanying drawings.

DETAILED DESCRIPTION

Smokeless Tobacco Container and Cutter Alignment

Figure 1:
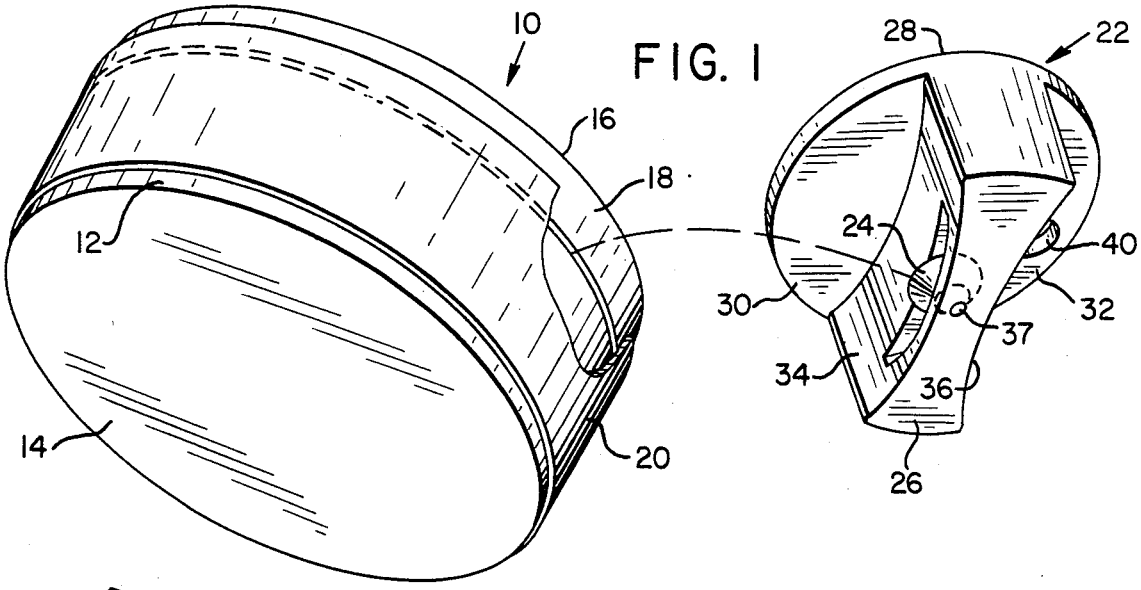
FIG. 1 is an isometric view of the present invention in association with a smokeless tobacco container prior to commencing a cutting operation.

FIG. 1 illustrates the profile of smokeless tobacco container 10. As shown in FIG. 1, container 10 is cylindrically shaped having side 12 and bottom 14 surfaces of paper or thin plastic covered by lid 16 of metal or plastic, respectively, with dependent flange 18 extending over the outer surface of side 12. Lid 16 is secured to side 12 of container 10 by an adhesive coated paper wrapper 20 which extends around the outer periphery of side 12.

FIG. 1 also shows the proper orientation of tool 22 relative to container 10 to accomplish opening of the container. It is apparent from FIG. 1 that cutting wheel 24 is positioned at a depth in holder 26 to slit paper wrapper 20 just below dependent flange 18 to open container 10.

Description of Container Opening Tool

Figure 4:
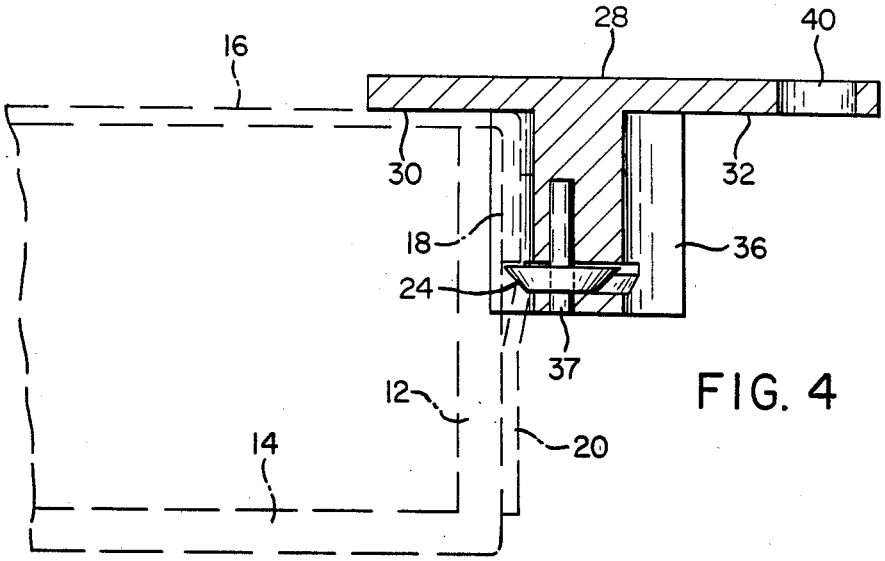
FIG. 4 is a fragmentary vertical sectional view taken along the line 4—4 of FIG. 2 showing the grasping surfaces and the cutting depth relative to the thickness of the dependent flange of the smokeless tobacco container.

As best shown in FIGS. 1 and 4, tool 22 has a body of unitary construction including circular top member 28 partitioned by holder 26 having a substantially I-shaped cross section. Holder 26 is perpendicularly disposed from the bottom surface of top member 28, thereby forming first flange 30 and second flange 32. Holder 26 and top member 28 comprise both a positioning means, which includes first concave surface 34 as a a guide means, and grasping surfaces for tool 22. Surface 34 and flange 30 constitute the positioning means for cutting wheel 24, and second concave surface 36 and flange 32 are the grasping surfaces for the user.

The user grasps flange 32 between his thumb and index finger. Surface 36 of holder 26 is shaped to follow the contour of the nail-bearing surface of the index finger as it exerts radially directed force against the rim of container 10 during an opening operation.

Figure 2:
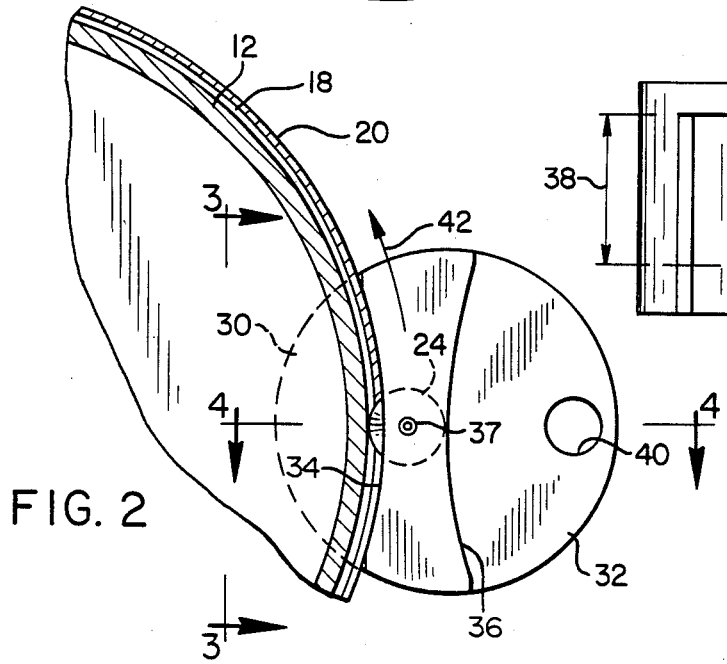
FIG 2 is a fragmentary bottom view of the tool during a cutting operation showing the conformal fit on the side surface of the smokeless tobacco container, which is shown partly in section.

As shown in FIG. 4, flange 30 rests on the upper surface of lid 16 during an opening operation to ensure that a uniform swath is cut around the periphery of side 12. As best seen in FIG. 2, surface 34 of holder 26 is a guide means for the tool which is shaped to conform to the contour of the side surface of container 10.

FIGS. 1, 2, and 4 show best the horizontal placement of cutting wheel 24 in holder 26 for restricting the depth of cut. The size of the radius of cutting wheel 24 is coordinated with the placement of pin 37, which constitutes the axis of rotation, in holder 26 so that the exposed edge protruding from holder 26 is no greater than the combined thickness of paper wrapper 20 and dependent flange 18. By restricting the exposed cutting edge as described hereinabove, the user can never slit side 12 while properly using tool 22 during a cutting operation.

In addition, placement of cutting wheel 24 within holder 26 as shown limits the amount of exposed cutting edge, thereby presenting a safety means during nonuse.

Figure 3:
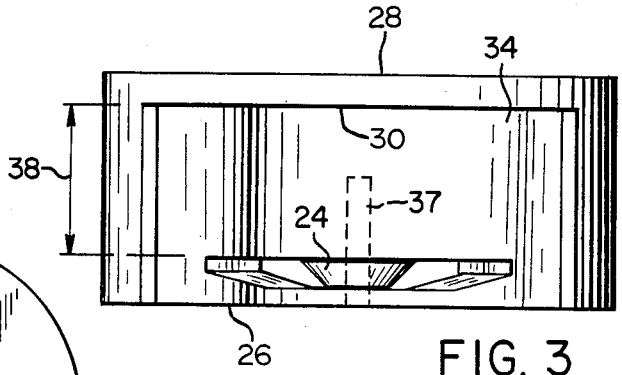
FIG. 3 is a side elevation view of the invention taken along the line 3—3 of FIG. 2 showing the position of the aperture in the guide surface of the holder containing the cutting wheel.

FIGS. 1, 3, and 4 show best the vertical placement of cutting wheel 24 relative to the top of lid 16. As shown by dimension 38 in FIG. 3, the top surface of cutting wheel 24 is set at a depth slightly greater than the length of dependent flange 18 as measured from the bottom surface of flange 30. When flange 30 rests upon the upper surface of lid 16 during a cutting operation, the vertical placement of cutting wheel 24 is such that a uniform swath of width substantially equal to the length of dependent flange 18 is induced.

Hole 40 shown in FIGS. 1, 2, and 4 allows tool 22 to be carried on a key chain for convenience.

Operation

A user accomplishes opening smokeless tobacco container 10 with tool 22 by first grasping flange 32 between the thumb and index finger and then mounting flange 30 on the upper surface of lid 16. The user exerts a radial force in the direction of the periphery of container 10 to initially slit paper wrapper 20 and align concave surface 34 against side surface 12 of the container. The user then revolves tool 22 about the periphery of the can, thereby slitting paper wrapper 20 at a depth just below dependent flange 18, as shown in FIG. 4, to open the container. FIG. 2 shows a direction of travel 42 of tool 22 relative to the periphery of container 10 for the particular orientation shown as the user moves either the tool in a counterclockwise sense or the container in a clockwise sense. Cutting wheel 24 rotates about the periphery of container 10, thereby slitting paper wrapper 20. Of course, the tool can be revolved about the container in either direction and, thus, can be used by either right- or left-handed persons.

The user may also open smokeless tobacco container 10 by rotating the container while tool 22 is held stationary. Similarly, the opening of container 10 can be accomplished by a combination of the opening operations described hereinabove.

Having illustrated and described what is presently the preferred embodiment of my invention, it should be apparent to those skilled in the art that the embodiment may be modified in arrangement and detail without departing from the principles of the invention which are intended to be illustrated but not limited by the disclosure. I therefore claim as my invention all such modifications as come within the true spirit and scope of the following claims.

What is claimed is:

1. A hand-held portable tool for opening a container comprising a cylindrical body having side and bottom surfaces and an open top closed by a lid having a dependent circular flange extending over the side surface of the body, the lid being secured to the side surface by a wrapper extending around the outer periphery of the side surface and the flange, the tool comprising:

a top member;

a guide member, the guide member being perpendicularly disposed with respect to the bottom surface of the top member, the guide member having two opposed side surfaces which are oppositely concavely curved inwardly toward each other generally near the center of the guide member, one of the side surfaces of the guide member being inwardly concavely curved to conform to the contour of a user's index finger as said finger exerts a radially directed force against the flange of the lid of the container and the other of the side surfaces of the guide member being inwardly concavely curved to conform to the contour of the side surface of the cylindrical body of the container, the guide member partitioning the top member into a pair of extending flanges, a first flange extending over and being adapted to rest on the upper surface of the container lid, a second flange extending outwardly and being adapted to be grasped by a user, the side surfaces of the guide member being offset with respect to the center of the bottom surface of the top member so that the one of the side surfaces of the guide member is longer than the other of the side surfaces of the guide member; and a cutting member protruding from the other of the side surfaces of the guide member, the cutting member being disposed a distance below the bottom surface of the top member to engage the side surface of the container body just below the dependent flange of the lid.

2. The tool of claim 1, wherein the cutting member protrudes from the other of the side surfaces of the guide member a distance substantially equal to the combined thickness of the wrapper and the dependent flange of the lid.

3. The tool of claim 2, wherein the cutting member comprises a cutting wheel mounted to the guide member, the axis of the wheel being perpendicular to the bottom surface of the top member.

* * * * *